US010487674B2

(12) United States Patent
Rehnsch

(10) Patent No.: US 10,487,674 B2
(45) Date of Patent: Nov. 26, 2019

(54) BLADE FASTENING MECHANISM HAVING A SECURING DEVICE FOR TURBINE BLADES

(71) Applicant: Siemens Aktiengesellschaft, Munich (DE)

(72) Inventor: Andreas Rehnsch, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 184 days.

(21) Appl. No.: 15/542,510

(22) PCT Filed: Jan. 5, 2016

(86) PCT No.: PCT/EP2016/050066
§ 371 (c)(1),
(2) Date: Jul. 10, 2017

(87) PCT Pub. No.: WO2016/116285
PCT Pub. Date: Jul. 28, 2016

(65) Prior Publication Data

US 2018/0266259 A1 Sep. 20, 2018

(30) Foreign Application Priority Data

Jan. 20, 2015 (EP) ..... 15151806

(51) Int. Cl.
*F01D 5/32* (2006.01)
*F01D 5/30* (2006.01)

(52) U.S. Cl.
CPC ..... *F01D 5/323* (2013.01); *F01D 5/3015* (2013.01); *F05D 2220/32* (2013.01); *F05D 2260/36* (2013.01); *F05D 2260/38* (2013.01)

(58) Field of Classification Search
None
See application file for complete search history.

(56) References Cited

U.S. PATENT DOCUMENTS 2,847,187 A 8/1958 Murphy
3,853,425 A * 12/1974 Scalzo ..... F01D 5/18 416/95
4,668,167 A 5/1987 Le Maout et al.
5,236,309 A 8/1993 Van Heusden et al.
(Continued)

FOREIGN PATENT DOCUMENTS

EP 1892380 A 2/2008
EP 2299060 A1 3/2011
(Continued)

OTHER PUBLICATIONS

EP Search Report dated Jul. 15, 2015, for EP patent application No. 15151806.5.
(Continued)

*Primary Examiner* — Jason D Shanske
*Assistant Examiner* — Jason G Davis
(74) *Attorney, Agent, or Firm* — Beusse Wolter Sanks & Maire

(57) ABSTRACT

A securing device for a turbine blade wherein the securing device prevents the turbine blade from moving radially and axially and includes a retaining piece that includes a projection which extends into a recess in the root of the turbine blade and which prevents the blade from moving axially.

16 Claims, 6 Drawing Sheets

(56) References Cited

U.S. PATENT DOCUMENTS

| | | | | |
|---|---|---|---|---|
| 5,431,543 | A | 7/1995 | Brown et al. | |
| 6,447,253 | B2 * | 9/2002 | Tempere | F01D 5/323 416/221 |
| 8,192,167 | B2 * | 6/2012 | Helmis | F01D 5/3015 416/204 R |
| 8,956,122 | B2 * | 2/2015 | Helmis | F01D 5/323 416/221 |
| 2009/0324414 | A1 | 12/2009 | Helmis et al. | |
| 2011/0027092 | A1 | 2/2011 | Engle | |
| 2012/0177499 | A1 | 7/2012 | Helmis et al. | |

FOREIGN PATENT DOCUMENTS

| | | | |
|---|---|---|---|
| JP | H01069702 | A | 9/1987 |
| JP | H01237304 | A | 9/1989 |
| JP | H07166804 | A | 6/1995 |
| JP | 2011122474 | A | 6/2011 |
| RU | 2427713 | C2 | 8/2011 |

OTHER PUBLICATIONS

International Search Report dated Mar. 29, 2016, for PCT/EP2016/050066.

RU search report dated Jun. 9, 2018, for RU patent application No. 2017129253/06.

* cited by examiner

BLADE FASTENING MECHANISM HAVING A SECURING DEVICE FOR TURBINE BLADES

CROSS REFERENCE TO RELATED APPLICATIONS

This application is the US National Stage of International Application No. PCT/EP2016/050066 filed Jan. 5, 2016, and claims the benefit thereof. The International Application claims the benefit of European Application No. EP15151806 filed Jan. 20, 2015. All of the applications are incorporated by reference herein in their entirety.

FIELD OF INVENTION

The invention relates to a rotor comprising at least one turbine blade and a securing device for axially and radially securing the turbine blade, wherein the rotor comprises a blade groove and the turbine blade comprises a turbine blade root, wherein the blade groove and the turbine blade root is adapted to the blade groove, wherein the securing device has a retaining piece which is arranged between the blade groove and the turbine blade root.

BACKGROUND OF INVENTION

Blade fastening mechanisms are normally used for fastening rotor blades on a rotor of a continuous-flow machine, in particular a steam turbine. As a result of the relatively high rotation of the rotor, the rotor blades arranged on the rotor are subjected to large centrifugal forces. The turbine blade root of the turbine blades must therefore withstand large forces and is forced radially outward in the blade groove. In addition to the centrifugal forces, high vibrational loads present a further problem and can lead to mechanical damage and material fatigue. Corrosion and traveling movement of the blade root due to steam impingement or vibrations inside the blade groove present further problems. In order to fix the turbine blade root inside the blade groove, various solutions, such as for example metal wedges, spring rings or sealing pieces, are known. Although metal wedges establish locking of the associated blade root inside a blade groove both axially and radially, in the case of large rotor blades it is difficult to generate sufficient retaining forces in the radial direction with such metal wedges during rotation. Furthermore, metal wedges exhibit corrosive behavior during extensive operation in the steam medium, and this makes dismantling difficult.

Axially threaded rotor blades are known which, in turbomachines, such as for example steam turbines, on account of the operating stress, require a construction which absorbs the axial operating forces of the turbine blade and keeps the blade in its axial position. Such securing mechanisms are also referred to as axial securing mechanisms. In the case of such axial securing mechanisms, there are normally arranged two notches which are formed in a superposed manner with respect to one another. However, superpositions of notches frequently have increased stress and therefore signify limited use in turbomachine construction.

SUMMARY OF INVENTION

It is an object of the invention to provide a blade fastening mechanism in a continuous-flow machine in which a precise and firm retention of blades and the associated blade holders is ensured over a long period of operation.

This object is achieved by way of a rotor comprising at least one turbine blade and a securing device for axially and radially securing the turbine blade, wherein the rotor comprises a blade groove and the turbine blade comprises a turbine blade root, wherein the blade groove and the turbine blade root is adapted to the blade groove, wherein the securing device has a retaining piece which is arranged between the blade groove and the turbine blade root, wherein the retaining piece has a projection which is arranged into a recess in the turbine blade root, wherein the projection engages into the recess in such a way that displacement of the retaining piece in the axial direction is prevented, wherein the securing device has a force spring which exerts a force, acting in the radial direction from the rotor, on the turbine blade.

The invention therefore proposes arranging a securing device into a space between the rotor and the turbine blade root. Said space is advantageously arranged in the rotor. The notch formed by the space is thus displaced in a radially inward direction towards the axis of rotation. Consequently, the forces applied to the rotor are distributed better.

Advantageous refinements are given in the subclaims.

In one refinement, the retaining piece is integrated directly into the blade root. In this case, this is distinctly formed, in the radially inward direction, either at the front edge of the blade root or advantageously at the rear edge of the blade root, as seen in the axial direction. A distinct formation at the front edge and rear edge is possible here of an axial recess, which further allows the axial insertion of the modified blade.

In a first advantageous refinement, the securing device has a plate which is arranged in a second recess in the retaining piece and in a rotor recess, wherein the plate engages into the second recess and into the rotor recess in such a way that displacement of the plate in the axial direction is prevented.

Active displacement in the axial direction of the retaining piece is thus prevented in an effective manner. The plate is in this case arranged into a rotor recess and into a second recess in the retaining piece and therefore forms a barrier for the retaining piece to be displaceable in the axial direction.

In an advantageous refinement, a force spring is arranged between the blade groove and the retaining piece.

Said force spring exerts a force from the rotor on the turbine blade root. During transportation and during operation, it is important, especially in the case of low rotational speeds, to exert a force on the turbine blade root which acts in a radial direction. Consequently, displacement of the turbine blade in the axial direction as a result of friction effects is further avoided. Above a certain rotational speed, centrifugal forces acting in the radial direction on the turbine blade are so large that the influence of the spring force due to the force spring can be neglected.

Advantageously, the force spring is arranged next to the retaining piece, between the blade groove and the blade root.

This is a particularly simple and constructive solution which is producible by simple means.

In a further advantageous refinement, the blade root has an arranged front edge, as seen in the axial direction, and a rear edge arranged opposite the front edge, as seen in the axial direction, wherein the retaining piece extends from the front edge to the rear edge.

Here, the invention now advantageously proposes refining the retaining piece in such a way that the dimensions in the axial direction are such that the retaining piece extends from the front edge to the rear edge.

In a further advantageous refinement, a first securing plate is arranged at the front edge and a second securing plate is arranged at the rear edge.

This prevents, in an effective manner, axial displacement of the retaining piece, both in one axial direction and in the oppositely-facing axial direction.

In a further advantageous refinement, a first force spring is arranged at the front edge and a second force spring is arranged at the rear edge.

As a result, symmetrical distributions of forces and vibrations, which arise in particular during start-up or during transportation, can be further minimized.

In a further advantageous refinement, the projection is of elongate design in the circumferential direction (with respect to the axis of rotation).

An elongate design is normally a relatively simple production process, which here will lead to a cost saving.

The projection is advantageously of rectangular cross section.

In a further advantageous refinement, the projection is formed as a cylinder and engages into a recess formed as a blind bore. This presents an alternative to the elongate design form of the projection. A locally-engaging force acts on the blind bore advantageously proposed here in which the cylinder formed as the projection engages.

The rotor recess and the second recess are advantageously arranged one above the other in the radial direction.

As a result of the orientation with a one-above-the-other arrangement in the radial direction, tilting of the plate is prevented in an effective manner. The above-described properties, features and advantages of this invention and the manner in which they are achieved become clearer and more easily understandable in conjunction with the following description of the exemplary embodiments, which are explained in more detail in conjunction with the drawings.

Exemplary embodiments of the invention are described below with reference to the drawings. Said drawings are not intended to illustrate the exemplary embodiments in a representative manner, but rather the drawing, where expedient for elucidations, is shown in schematic and/or slightly distorted form. With respect to additions to the teaching directly identifiable in the drawing, reference is made to the relevant prior art.

DETAILED DESCRIPTION OF INVENTION

Figure 1:
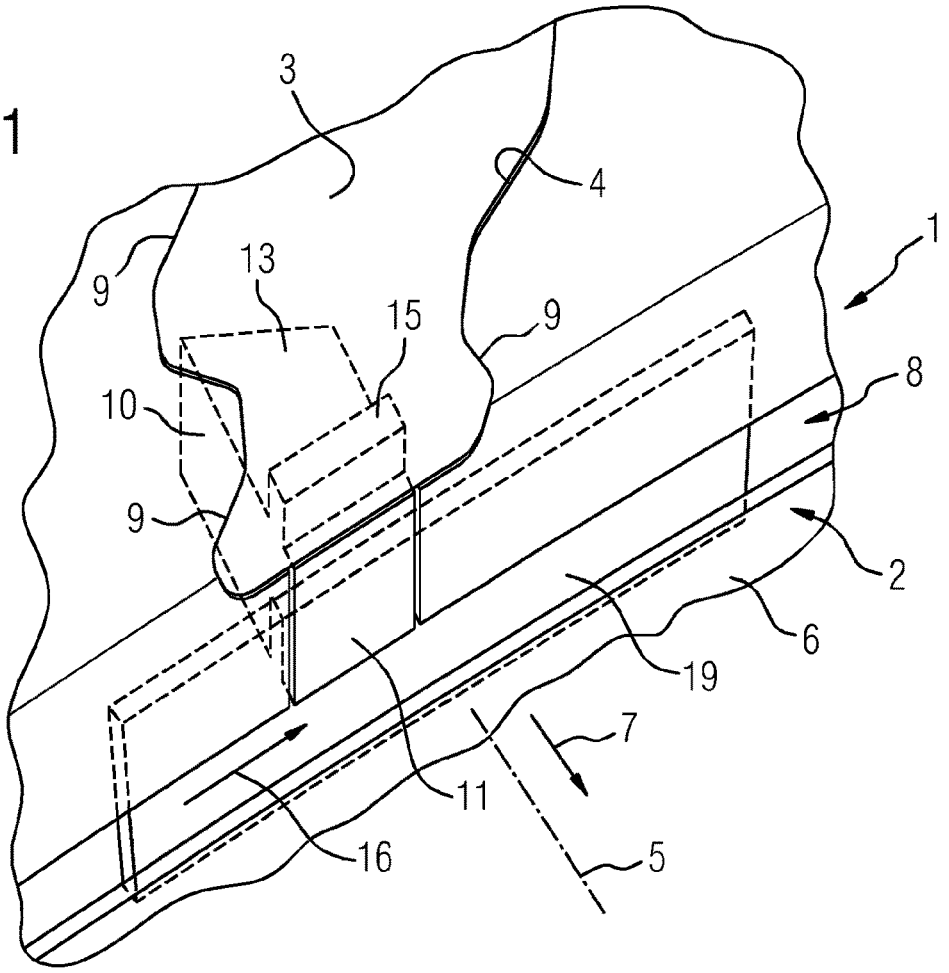
FIG. 1 shows a perspective view of a securing device.

FIG. 1 shows a securing device 1. According to FIG. 1, part of a rotor 2 and of a turbine blade root 3 can be seen. For the sake of clarity, the blade airfoil of the turbine blade is not illustrated. The rotor has a blade groove 4. Said blade groove 4 may be a blade groove 4 which is formed in a manner parallel to an axis of rotation 5 of the rotor. The blade groove 4 may also be a curved blade groove 4 which is then arranged at a front edge in the axial direction 7.

The axis of rotation 5 and the axial direction 7 are arranged parallel to one another. The rotor 2 rotates about the axis of rotation 5 at a rotational speed. The turbine blade is adapted in the blade groove 4 such that there is as little play as possible between the turbine blade root 3 and the blade groove 4. Without the securing device 8, it would be possible for the turbine blade to be displaced freely in the axial direction 7.

Figure 2:
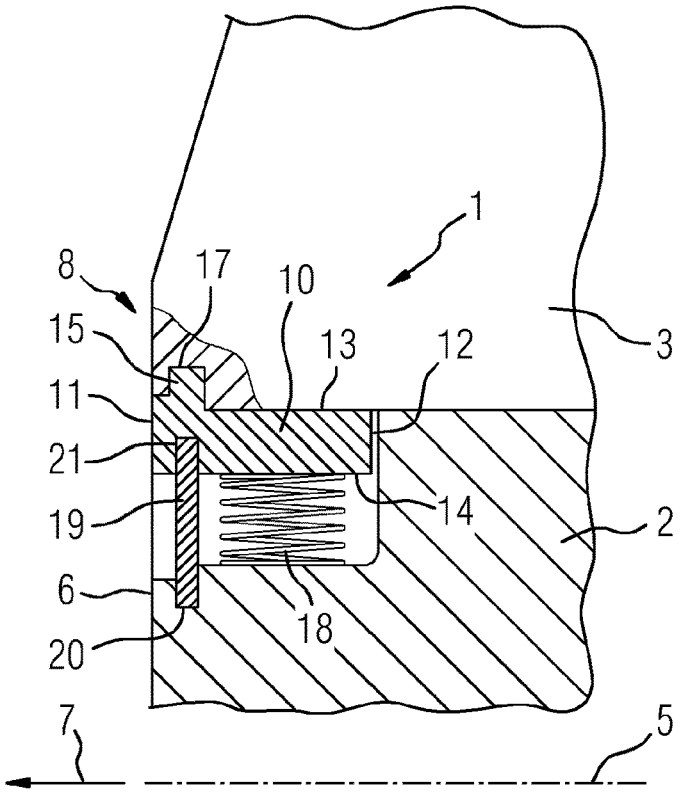
FIG. 2 shows a cross-sectional view of a first variant of the securing device.

The rotor 2 and the turbine blade may be part of a turbomachine, for example a steam turbine. During the start-up of a continuous-flow machine, the centrifugal forces are still relatively small, and during transportation, there are no centrifugal forces present at all. Consequently, it is possible that the turbine blade is displaceable in the axial direction 7. This is prevented by way of a securing device 8. Above a certain rotational frequency, the centrifugal forces are so large that the turbine blade presses, in the blade groove 4, against so-called bearing flanks 9 and thereby acquires a stable position. Above this certain rotational frequency, axial displacement is difficult. With the securing device 8, displacement of the turbine blade in the axial direction 7 and in the radial direction is prevented in an effective manner. The securing device 8 comprises a retaining piece 10. FIGS. 1 to 5 show a first design of the retaining piece 10. The retaining piece 10 is arranged between the blade groove 4 and the turbine blade root 3. The retaining piece 10 comprises a front side 11 which is arranged at the front edge 6. At the side opposite the front side 11, a rear side 12 is arranged (visible only in FIG. 2). The retaining piece 10 has a top side 13 and a bottom side 14. The top side 13 is arranged opposite the bottom side 14. The top side 13 bears against a bottom side of the turbine blade root 3, as illustrated in FIG. 2. The front side 11 and the front edge 6 are in this case flush. The bottom side 14 of the retaining piece 10 faces in the direction of the axis of rotation 5.

The retaining piece has, on the top side 13, a projection 15 which, according to a first variant of the invention, is of elongate design in a circumferential direction 16. The projection 15 is of rectangular cross section. The projection 15 is formed over the entire top side 13 and extends into a recess 17 in the turbine blade root 3. The recess 17 is in this case of complementary design with respect to the projection 15. This means that the recess 17 is also of elongate design and rectangular cross section.

If the projection is arranged in the recess 17, the retaining piece can no longer be displaced in the axial direction 7, and so displacement of the retaining piece 10 in the axial direction 7 is prevented.

As shown in FIG. 2, there is, between the bottom side 14 and the rotor 2, a space in which a force spring 18 is arranged. The force spring 18 leads to a force from the rotor 2 to the retaining piece 10 and then finally to the turbine blade root 3. Said force prevents the retaining piece 10 from jumping out of the recess 17. For further securing, the securing device 8 has a plate 19 which engages into a rotor recess 20 and into a second recess 21, such that displacement of the plate 19 in the axial direction 7 is prevented. The second recess 21 is arranged in the retaining piece 10. The plate 19 is in this case pushed in from the side. The plate 19 is formed in such a way that it faces in the circumferential direction 16.

Figure 3:
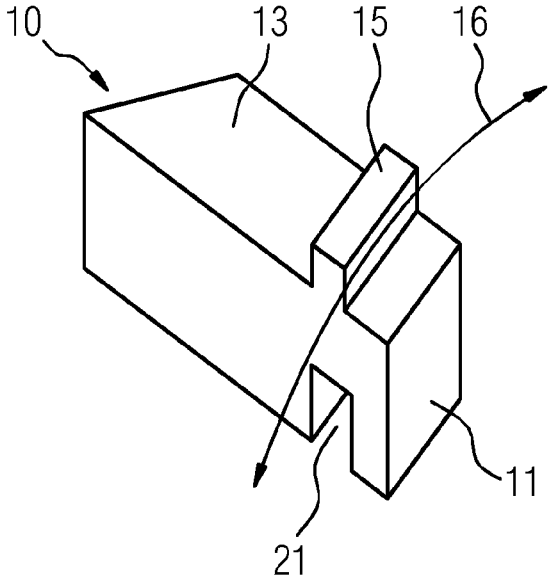
FIG. 3 is a perspective illustration of the retaining piece according to the first variant from FIG. 2.
Figure 4:
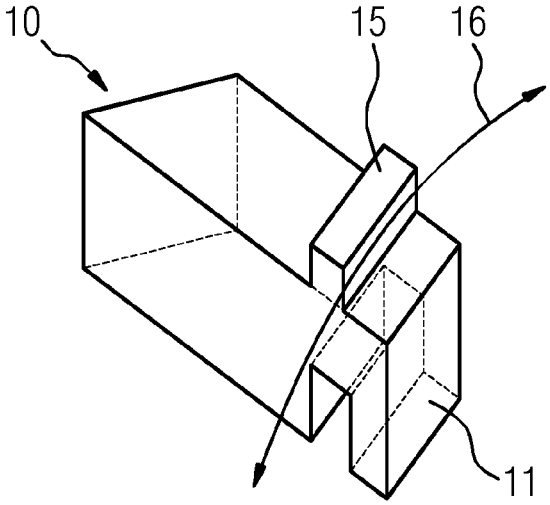
FIG. 4 is a further perspective illustration of the retaining piece from FIG. 3.
Figure 5:
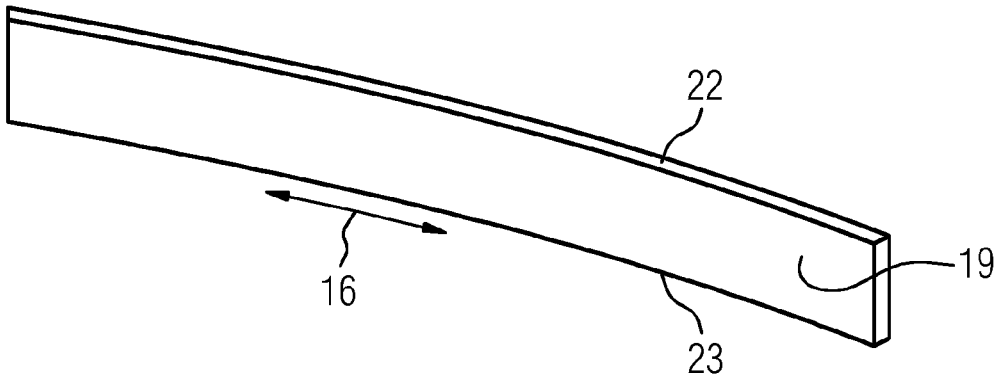
FIG. 5 is a perspective illustration of a plate.
Figure 6:
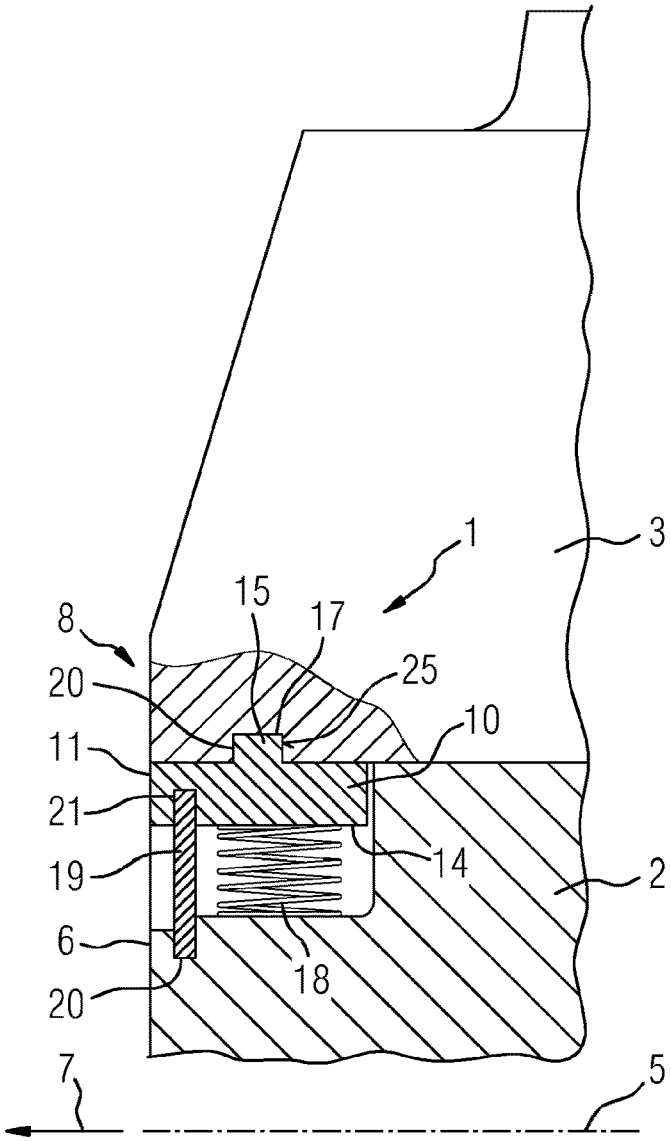
FIG. 6 shows a cross-sectional view of a securing device according to a second variant.

FIG. 2 shows a cross-sectional view of said first variant of the retaining piece 10 and of the entire securing device 8. FIGS. 3 and 4 show a perspective view of the retaining piece 10 in the first variant thereof. FIG. 5 shows the plate 19 which is formed in a circumferential direction 16. The plate has a plate top side 22 which extends into the second recess 21. The plate bottom side 23 extends into the rotor recess 20.

FIGS. 6 to 9 show a second variant of the securing device 8.

The difference of the securing device 8 according to the second variant with respect to the securing device 8 of the first variant is that the projection 15 is not of elongate design but is formed as a cylinder 24 and extends into a blind bore in the turbine blade root 3. In this case, the cylinder 24 has a similar mode of action to the projection 15 according to FIG. 1, that is to say displacement in the axial direction 7 is prevented.

Figure 7:
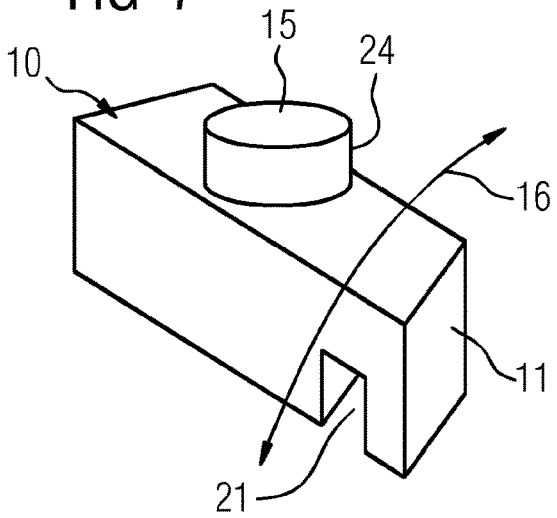
FIG. 7 is a perspective illustration of the retaining piece according to the second variant from FIG. 6.
Figure 8:
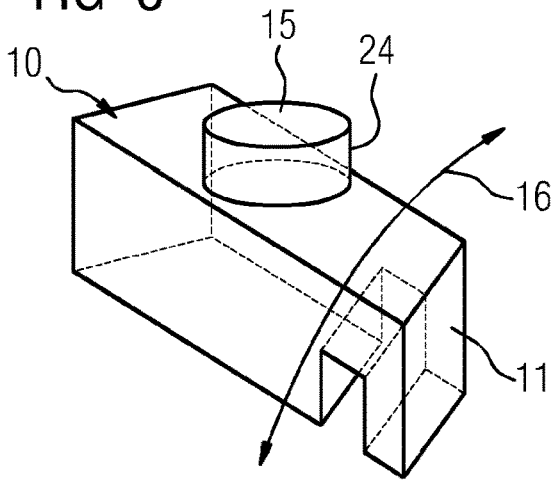
FIG. 8 is a further perspective illustration of the retaining piece from FIG. 7.

FIGS. 7 and 8 show a perspective view of the retaining piece 10 according to variant 2.

Figure 9:
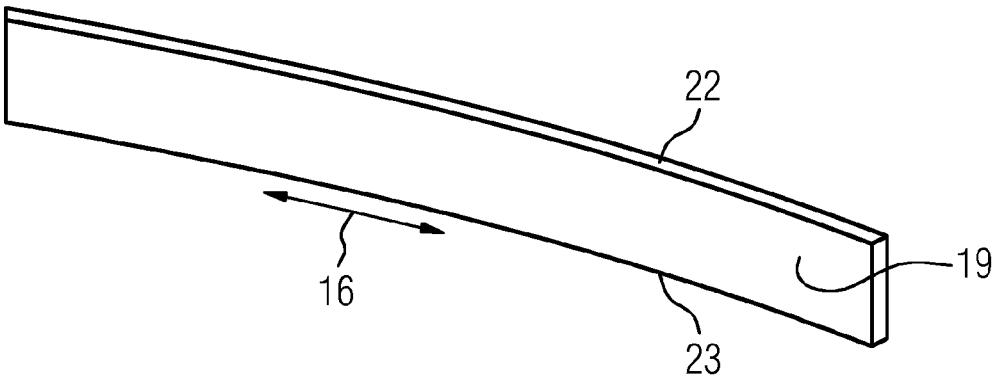
FIG. 9 is a perspective illustration of the plate.

FIG. 9 shows the plate 19 which is designed for variant 2, wherein the plate 19 according to variant 1 and variant 3 is identical.

The plate 19 is arranged in an encircling manner in the circumferential direction 16 and is in this case formed in a segmented manner. This means that the plate 19 is composed of individual segments. The plate 19 is arranged in a form-fitting manner in the rotor recess 20 and in the second recess. The plates 19 are inserted to a circumferential position via a milled opening of the encircling groove and pushed to their final position, and following insertion of the last segment, the segments are joined to one another at the divisions by spot welding. The force spring 18 serves for ensuring that the turbine blade bears against the rotor 2 in a standstill state, e.g. during transportation. The force spring 18 is designed for example as a disk spring. The force spring 18 can also be designed as a clamping piece, however.

Figure 10:
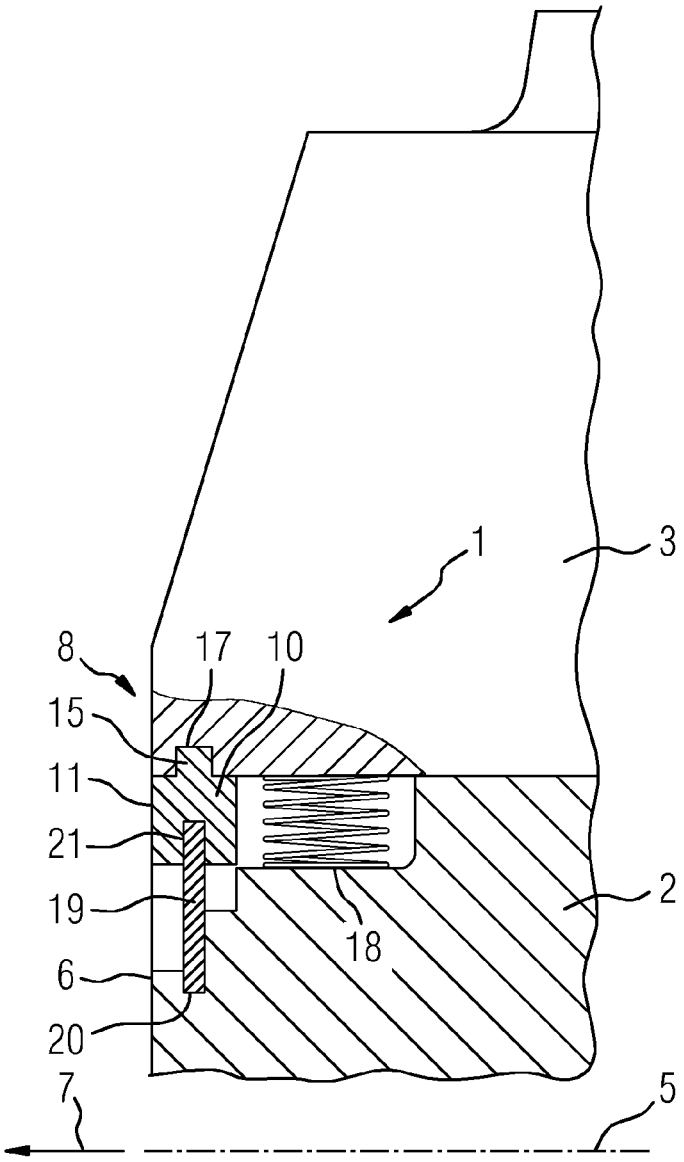
FIG. 10 shows a cross-sectional view of a securing device according to a third variant.
Figure 11:
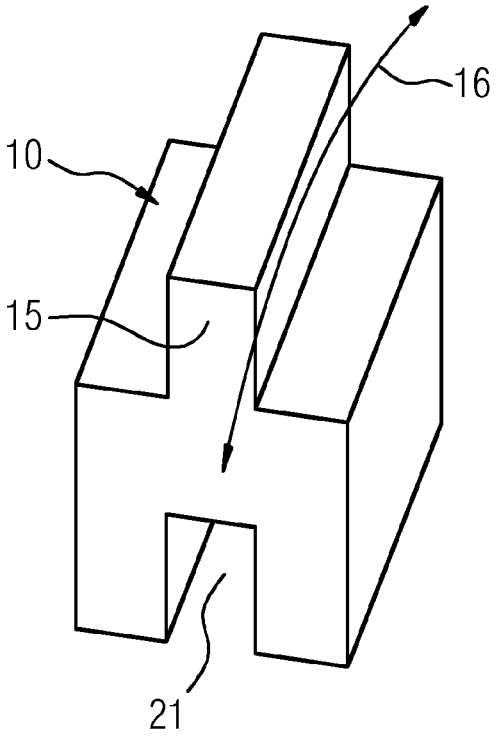
FIG. 11 shows a perspective view of the retaining piece according to the third variant.
Figure 12:
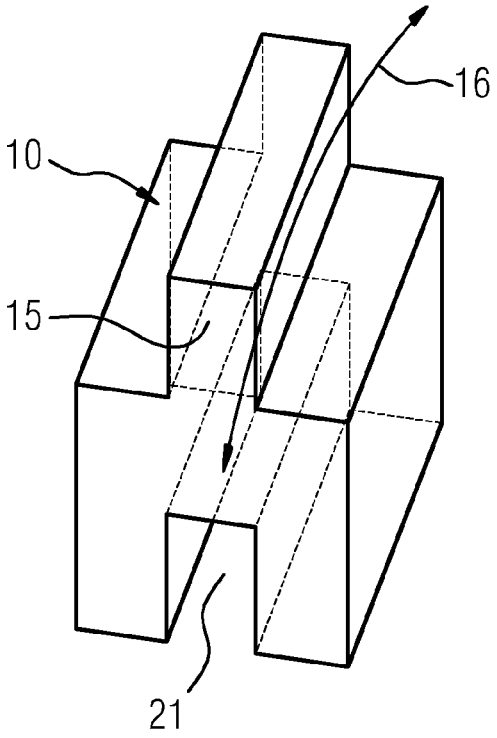
FIG. 12 shows a further perspective view of the retaining piece according to FIG. 11 for the third variant.
Figure 13:
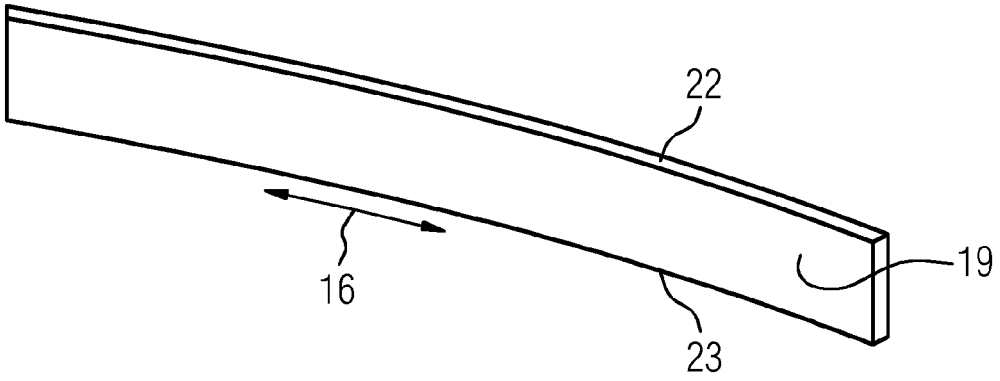
FIG. 13 is an illustration of the plate for the third variant.

FIGS. 10 to 13 show a third variant of the securing device 8. The third variant is characterized in that the retaining piece 10 and the force spring 18 are arranged next to one another in the axial direction 7. This means that the force spring 18 is arranged directly on the rotor 2 and directly on the turbine blade root 3, and the force is transmitted directly from the rotor 2 to the turbine blade root 3. The retaining piece 10 is arranged next to the force spring 18 in the axial direction 7. The retaining piece 10 likewise has a projection 15 and a second recess 21. According to the first variant, the projection 15 may be of elongate design. Also, according to the second variant, the projection 15 may be formed as a cylinder. FIG. 10 shows a cross-sectional view of the securing device 8 according to the third variant. FIGS. 11 and 12 show a perspective view of the retaining piece 10. FIG. 13 shows a perspective view of the plate 19.

Figure 14:
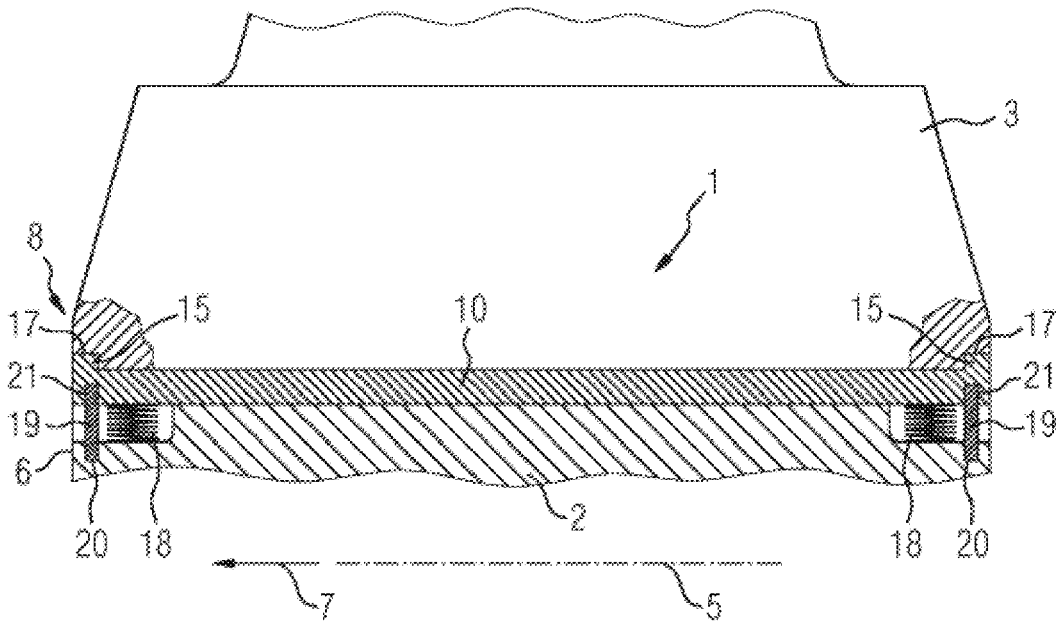
FIG. 14 shows a cross-sectional view of the securing device according to a fourth variant.
Figure 15:
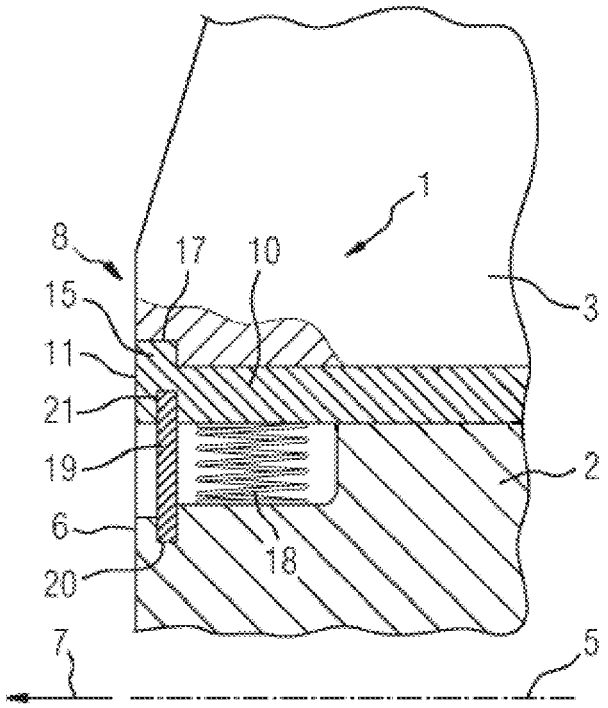
FIG. 15 shows a cross-sectional view of part of the securing device according to the fourth variant.

FIGS. 14 and 15 show a fourth variant of the securing device 8. The securing device 8 according to the fourth variant is characterized in that the retaining piece 10 is now formed from the front edge 6 of the turbine blade root 3 to the rear edge of the turbine blade root. This means that the retaining piece 10 is arranged completely from the front edge 6 to the rear edge. The retaining piece 10 likewise has a projection 15 which engages into a recess 17. Furthermore, provision is likewise made for a plate 19 which engages into a second recess 21 and into a rotor recess 20. The force spring 18 is likewise arranged between the retaining piece 10 and the rotor 2.

Although the invention has been more specifically illustrated and described in detail by the preferred exemplary embodiment, the invention is not limited by the examples disclosed and other variations can be derived herefrom by a person skilled in the art, without departing from the protective scope of the invention.

The invention claimed is:

1. A rotor comprising:

a turbine blade, and a securing device for axially and radially securing the turbine blade, wherein the rotor comprises a blade groove, wherein the turbine blade comprises a turbine blade root adapted to the blade groove, wherein the securing device comprises a retaining piece which is arranged between the blade groove and the turbine blade root, wherein the retaining piece comprises a surface facing towards the turbine blade root, wherein the surface bears against the turbine blade root, wherein the retaining piece comprises, on the surface, a projection which is arranged into a recess in the turbine blade root, wherein the projection engages into the recess in such a way that displacement of the turbine blade in an axial direction is prevented, wherein the securing device comprises a force spring which exerts a force acting in a radial direction from the rotor on the turbine blade, wherein the securing device comprises a securing plate which is disposed in a first groove in the retaining piece and in a rotor recess, wherein an interaction between the securing plate and the rotor recess prevents displacement of the securing plate upstream and downstream axially, and wherein an interaction between the securing plate and the first groove prevents displacement of the retaining piece upstream and downstream axially.

2. The rotor as claimed in claim 1, wherein the force spring is a separate component from the retaining piece and the securing plate.

3. The rotor as claimed in claim 1, wherein the recess is of complementary design with respect to the projection.

4. The rotor as claimed in claim 1, wherein the projection is of rectangular cross section.

5. The rotor as claimed in claim 1, wherein the force spring is arranged between the blade groove and the retaining piece.

6. The rotor as claimed in claim 1, wherein the force spring is arranged next to the retaining piece, between the blade groove and the turbine blade root.

7. The rotor as claimed in claim 1, wherein the turbine blade root comprises a front edge, as seen in the axial direction, and a rear edge arranged opposite the front edge, as seen in the axial direction, and wherein the retaining piece extends from the front edge to the rear edge.

8. The rotor as claimed in claim 7, wherein the securing plate is arranged at the front edge and a second securing plate is arranged at the rear edge.

9. The rotor as claimed in claim 8, wherein the second securing plate is disposed in a second groove in the retaining piece and in a second rotor recess, wherein an interaction between the second securing plate and the second rotor recess prevents displacement of the second securing plate upstream and downstream axially, and wherein an interaction between the second securing plate and the second groove prevents displacement of the retaining piece upstream and downstream axially.

10. The rotor as claimed in claim 7, wherein the force spring is arranged at the front edge and a second force spring is arranged at the rear edge.

11. The rotor as claimed in claim 7, wherein the retaining piece comprises a second projection arranged at the rear edge and disposed in a second recess in the turbine blade root, wherein the projection prevents axial displacement in a first axial direction, and wherein the second projection engages into the second recess in such a way that displacement of the turbine blade in a second axial direction opposite the first axial direction is prevented.

12. The rotor as claimed in claim 1, wherein the projection is of elongate design in a circumferential direction which is oriented with respect to an axis of rotation of the rotor.

13. The rotor as claimed in claim 1, wherein the projection is formed as a cylinder and engages into the recess formed as a blind bore.

14. The rotor as claimed in claim 1, wherein the rotor recess and the first groove are arranged one on top of the other in the radial direction.

15. The rotor as claimed in claim 1, wherein the force spring is a disk spring.

16. The rotor as claimed in claim 1, wherein the projection engages into the recess in such a way that displacement of the turbine blade upstream and downstream axially is prevented.

* * * * *